US009238375B2

(12) United States Patent
Lakin et al.

(10) Patent No.: US 9,238,375 B2
(45) Date of Patent: Jan. 19, 2016

(54) TAPE DRIVE AND METHOD OF OPERATION

(71) Applicant: Markem-Imaje Industries Limited, Nottingham (GB)

(72) Inventors: Phillip Lakin, Nottingham (GB); Simon Starkey, Leicester (GB)

(73) Assignee: Dover Europe Sàrl, Vernier (CH)

( * ) Notice: Subject to any disclaimer, the term of this patent is extended or adjusted under 35 U.S.C. 154(b) by 0 days.

(21) Appl. No.: 14/179,145

(22) Filed: Feb. 12, 2014

(65) Prior Publication Data

US 2014/0225969 A1 Aug. 14, 2014

(30) Foreign Application Priority Data

Feb. 12, 2013 (GB) ..... 1302462.5

(51) Int. Cl.

| | |
|---|---|
| ***B41J 33/34*** | (2006.01) |
| ***B41J 33/36*** | (2006.01) |
| ***B41J 2/325*** | (2006.01) |
| ***B41J 33/14*** | (2006.01) |

(52) U.S. Cl.

CPC *B41J 2/325* (2013.01); *B41J 33/14* (2013.01); *B41J 33/34* (2013.01); *B41J 33/36* (2013.01)

(58) Field of Classification Search

USPC ..... 347/215, 217; 400/223, 232, 234, 236, 400/225

See application file for complete search history.

(56) References Cited

U.S. PATENT DOCUMENTS

| | | | | |
|---|---|---|---|---|
| 4,924,240 | A | 5/1990 | Herbert | |
| 5,254,924 | A | 10/1993 | Ogasawara | |
| 5,325,115 | A | 6/1994 | Tanahashi | |
| 5,614,803 | A | 3/1997 | Morioka | |
| 5,751,331 | A | 5/1998 | Higuchi | |
| 5,908,251 | A | 6/1999 | Buckby | |
| 5,921,689 | A | 7/1999 | Buckby | |
| 5,975,777 | A | 11/1999 | Nelson | |
| 6,068,206 | A | 5/2000 | Lindsay | |
| 6,082,914 | A * | 7/2000 | Barrus et al. | 400/234 |
| 6,305,629 | B1 | 10/2001 | Chliwnyj | |
| 6,757,129 | B2 | 6/2004 | Kuroiwa | |
| 6,975,087 | B1 | 12/2005 | Crabill | |
| 7,150,572 | B2 * | 12/2006 | McNestry et al. | 400/223 |

(Continued)

FOREIGN PATENT DOCUMENTS

| | | | |
|---|---|---|---|
| EP | 745890 | A1 | 12/1996 |
| EP | 947345 | A3 | 3/2000 |

(Continued)

OTHER PUBLICATIONS

Intellectual Property Office, Third Party Observations regarding Application No. GB1302462.5, Jan. 6, 2015, 6 pages.

(Continued)

*Primary Examiner* — Huan Tran

(74) *Attorney, Agent, or Firm* — Fish & Richardson P.C.

(57) ABSTRACT

A method of operating a tape drive which includes a pair of tape spool supports, upon one of which a supply spool is mountable and upon a second one of which a take up spool is mountable, each tape spool support being driveable by a respective motor to transfer tape between the spools, the tape drive further including a controller to control each of the motors, wherein the method includes reducing tension in tape extending between the two spools during a period when the tape is substantially stationary.

20 Claims, 3 Drawing Sheets

(56) References Cited

U.S. PATENT DOCUMENTS

| | | | | |
|---|---|---|---|---|
| 7,682,094 | B2 | 3/2010 | McNestry | |
| 7,722,268 | B2 | 5/2010 | McNestry | |
| 7,748,917 | B2 | 7/2010 | McNestry | |
| 7,753,605 | B2 | 7/2010 | McNestry | |
| 8,007,190 | B2 | 8/2011 | McNestry | |
| 8,096,715 | B2 | 1/2012 | McNestry | |
| 8,221,009 | B2 | 7/2012 | McNestry | |
| 8,221,010 | B2 | 7/2012 | McNestry | |
| 8,317,421 | B2 * | 11/2012 | McNestry | 400/234 |
| 8,328,441 | B2 | 12/2012 | McNestry | |
| 8,591,127 | B2 | 11/2013 | McNestry | |
| 8,730,287 | B2 | 5/2014 | Bouverie | |
| 8,770,874 | B2 | 7/2014 | McNestry | |
| 2003/0049065 | A1 | 3/2003 | Barrus | |
| 2004/0146331 | A1 * | 7/2004 | McNestry et al. | 400/615.2 |
| 2008/0217454 | A1 * | 9/2008 | Trago | 242/332.7 |
| 2008/0219740 | A1 | 9/2008 | McNestry | |
| 2008/0219741 | A1 | 9/2008 | McNestry | |
| 2008/0219743 | A1 * | 9/2008 | McNestry et al. | 400/234 |
| 2009/0302143 | A1 | 12/2009 | Bayang | |
| 2009/0309949 | A1 | 12/2009 | Fukutani | |
| 2010/0089962 | A1 | 4/2010 | Mehlis et al. | |
| 2010/0172682 | A1 | 7/2010 | Hart | |
| 2013/0039685 | A1 | 2/2013 | Starkey | |
| 2013/0215210 | A1 | 8/2013 | McNestry et al. | |

FOREIGN PATENT DOCUMENTS

| | | | |
|---|---|---|---|
| EP | 1055521 | A3 | 5/2003 |
| FR | 2783459 | A1 | 3/2000 |
| GB | 1550218 | A | 8/1979 |
| GB | 2022018 | A | 12/1979 |
| GB | 2289441 | A | 11/1995 |
| GB | 2310405 | A | 8/1997 |
| GB | 2448302 | A | 10/2008 |
| GB | 2449676 | A | 12/2008 |
| GB | 2478725 | A | 9/2011 |
| GB | 2493541 | A | 2/2013 |
| JP | 62087382 | A | 4/1987 |
| JP | 6312568 | A | 11/1994 |
| JP | 8002078 | B2 | 1/1996 |
| JP | 8067045 | A | 3/1996 |
| JP | 9001906 | A | 1/1997 |
| JP | 04339680 | B2 | 10/2009 |
| JP | 04347659 | B2 | 10/2009 |
| WO | WO02022371 | A3 | 8/2002 |
| WO | WO03029013 | A1 | 4/2003 |
| WO | WO2008107642 | A1 | 9/2008 |
| WO | WO2008107647 | A1 | 9/2008 |
| WO | WO2008107650 | A1 | 9/2008 |
| WO | WO2013021211 | A3 | 4/2013 |

OTHER PUBLICATIONS

Intellectual Property Office, Search Report dated Jan. 17, 2012, GB Application No. GB1113777.5, 3 pages.

Authorized Officer Athina Nickitas-Etienne, International Preliminary Report on Patentability, International Application No. PCT/GB2012/051954, issued Feb. 11, 2014, 5 pages.

Communication pursuant to Rule 114(2) EPC dated Oct. 22, 2014, European Patent Application No. 12758588.3, Observations Pursuant to Article 115 EPC.

European Patent Application No. 12758588.3, Further Examination Report dated Nov. 26, 2014.

Communication from EP Intellectual Property Office dated Jul. 11, 2013, Observations pursuant to Section 21 of the Patents Act 1977, to be published by the USPTO.

European Search Report, Application No. EP 13 19 2034, dated Mar. 25, 2014, 6 pages.

U.S. Appl. No. 14/179,832, Office Action Summary mailed Dec. 16, 2014, 18 pages.

U.S. Appl. No. 14/179,483, Office Action Summary mailed Dec. 5, 2014, 17 pages.

U.S. Appl. No. 13/237,802, Office Action Summary mailed Jan. 2, 2014, 19 pages.

U.S. Appl. No. 13/237,802, Response to Action of Jan. 2, 2014, filed Apr. 2, 2014, 14 pages.

U.S. Appl. No. 13/237,802, Final Office Action Summary mailed Jul. 24, 2014, 23 pages.

U.S. Appl. No. 13/237,802, Reply to Action of Jul. 24, 2014, filed Sep. 24, 2014, 9 pages.

U.S. Appl. No. 13/237,802, Reply to Action of Jul. 24, 2014, filed Dec. 19, 2014, 9 pages.

U.S. Appl. No. 13/237,802, Office Action Summary mailed Jan. 20, 2015, 17 pages.

U.S. Appl. No. 14/075,935, Reply to Action of Dec. 26, 2014, filed Mar. 26, 2015, 7 pages.

* cited by examiner

TAPE DRIVE AND METHOD OF OPERATION

CROSS-REFERENCE TO RELATED APPLICATIONS

This application claims the benefit of priority under 35 U.S.C. §119 of UK Patent Application No. 1302462.5, filed Feb. 12, 2013.

FIELD OF THE INVENTION

This invention relates to a tape drive and a method of operating such a tape drive.

BACKGROUND OF THE INVENTION

In a so called thermal transfer printing apparatus, the printhead includes a plurality of thermal heating elements which are selectively energisable by a controller during printing to warm and soften pixels of ink from the tape and to transfer such pixels to the substrate. The printhead presses the tape against the substrate such that the pixels of ink contact the substrate before the web of the tape is peeled away, thus transferring the pixels of ink from the tape to the substrate.

Such printing apparatus includes drive apparatus for moving the tape relative to the printhead, to present fresh tape, from which pixels of ink are yet to be removed, to the printhead, such that successive printing operations can be carried out. It has long been known to provide tape drives which include two spool supports, one of which supports a supply spool on which unused tape is initially wound, and the other of which supports a take-up spool, onto which the tape is wound after it has been used. Tape extends between the spools in a tape path.

Each of the spool supports, and hence each of the spools of tape, is drivable by a respective motor.

It is known to provide thermal transfer printing apparatus in two different configurations. In the first, so called "intermittent" configuration, the substrate to be printed and the tape are held stationary during a printing operation, whilst the printhead is moved across the area of the substrate to be printed. Once the printing operation is complete, the printhead is lifted away from the tape, and the tape is advanced to present a fresh region of tape to the printhead for the next printing operation.

SUMMARY OF THE INVENTION

In the second, so called "continuous" configuration, the substrate to be printed moves substantially continuously and the tape is accelerated to match the speed of the tape before the printhead is brought into thermal contact with the tape and the printing operation is carried out. In this configuration, the printhead is maintained generally stationary during each printing operation.

The invention is particularly useful in relation to a printing apparatus which utilises a printing tape or "ribbon" which includes a web carrying marking medium, e.g. ink, and a printhead which, in use, removes marking medium from selected areas of the web to transfer the marking medium to a substrate to form an image, such as a picture or text.

More particularly, but not exclusively, the invention relates to a so called thermal transfer printing apparatus. The tape used in thermal transfer printers is thin. Therefore it is important to ensure that the tension in the tape extending between the two spools is maintained at a suitable value or within a suitable range of tensions, in particular to enable the web to peel cleanly away from the heated ink. Too much tension in the tape is likely to lead to the tape being deformed or broken, whilst too little tension will inhibit the correct operation of the device. A slack tape is likely to affect print quality and lead to the tape becoming misaligned in the tape drive. A misaligned tape can mean the take-up spool fails to wind evenly, leading to loss of tape control. Also, in a thermal transfer printer a misaligned tape means there may not be ink under the energised printing elements, resulting in a failure to print.

Known tape drives establish the required tension in the tape and maintain that tension as the tape is used during printing operations. Maintaining the tension in the tape requires the spool motors to be energised, which requires a continuous supply of electrical power to the motors.

According to a first aspect of the invention, there is provided a method of operating a tape drive which includes a pair of tape spool supports, upon one of which a supply spool is mountable and upon a second one of which a take up spool is mountable, each tape spool support being driveable by a respective motor to transfer tape between the spools, the tape drive further including a controller to control each of the motors, wherein the method includes reducing tension in tape extending between the two spools, during a period when the tape is substantially stationary.

This technique enables a tape drive to be operated in an energy-saving mode. This invention is particularly useful in tape drives where maintaining the tension in the tape when the tape is stationary is less critical than when the tape is moving.

The tension may be reduced during at least one period of inactivity of the tape drive, during which the tape is substantially stationary.

The reduction in tension during the at least one period of inactivity may reduce the amount of electrical energy required to operate the tape drive.

The or each period of inactivity may meet a predetermined criterion.

The period of inactivity may exceed a predetermined duration.

The period of inactivity may be selected before the period of inactivity begins.

The period of inactivity is preferably greater than or equal to a period during which the tape settles following a printing operation. The period of inactivity may be dependent upon characteristics of the tape being transferred, and may be known for a given tape, which would enable the predetermined period of inactivity to be selected.

The controller may initiate the reduction in tension once the period of inactivity meets the predetermined criterion.

The tension may be reduced from an operating tension of approximately 3N.

The tension may be reduced to a rest tension of approximately 1N

The amount of torque provided by at least one of the motors may be reduced.

The controller may control at least one of the motors to rotate its associated spool by an amount required to reduce the tension by a desired amount.

According to a second aspect of the invention there is provided a tape drive including a pair of tape spool supports, upon one of which a supply spool is mountable and upon a second one of which a take up spool is mountable, each tape spool support being driveable by a respective motor to transfer tape between the spools, the tape drive further including a controller to control each of the motors, wherein the controller is operable to control at least one of the motors to reduce the tension in a tape extending between the two spools when the tape is substantially stationary.

At least one of the motors for driving the spools may be a stepper motor.

Both of the motors for driving the spools may be stepper motors.

At least one of the motors for driving the spools may be a DC motor.

Both of the motors for driving the spools may be DC motors.

The or each DC motor may have an associated sensor for determining the angular position and rotational speed of the motor, and the or each motor may be operable in a first control mode in which position is a dominant control parameter and in a second control mode in which torque is a dominant control parameter.

According to a third aspect of the invention, there is provided a printing apparatus including a tape drive according to the second aspect of the invention for transferring a tape carrying a marking medium and a printhead for transferring the marking medium to a substrate.

The printing apparatus may be a thermal transfer printing apparatus.

DESCRIPTION OF THE DRAWINGS

The invention will now be described, by way of example only, with reference to the accompanying drawings, of which.

DETAILED DESCRIPTION OF THE INVENTION

Figure 1:
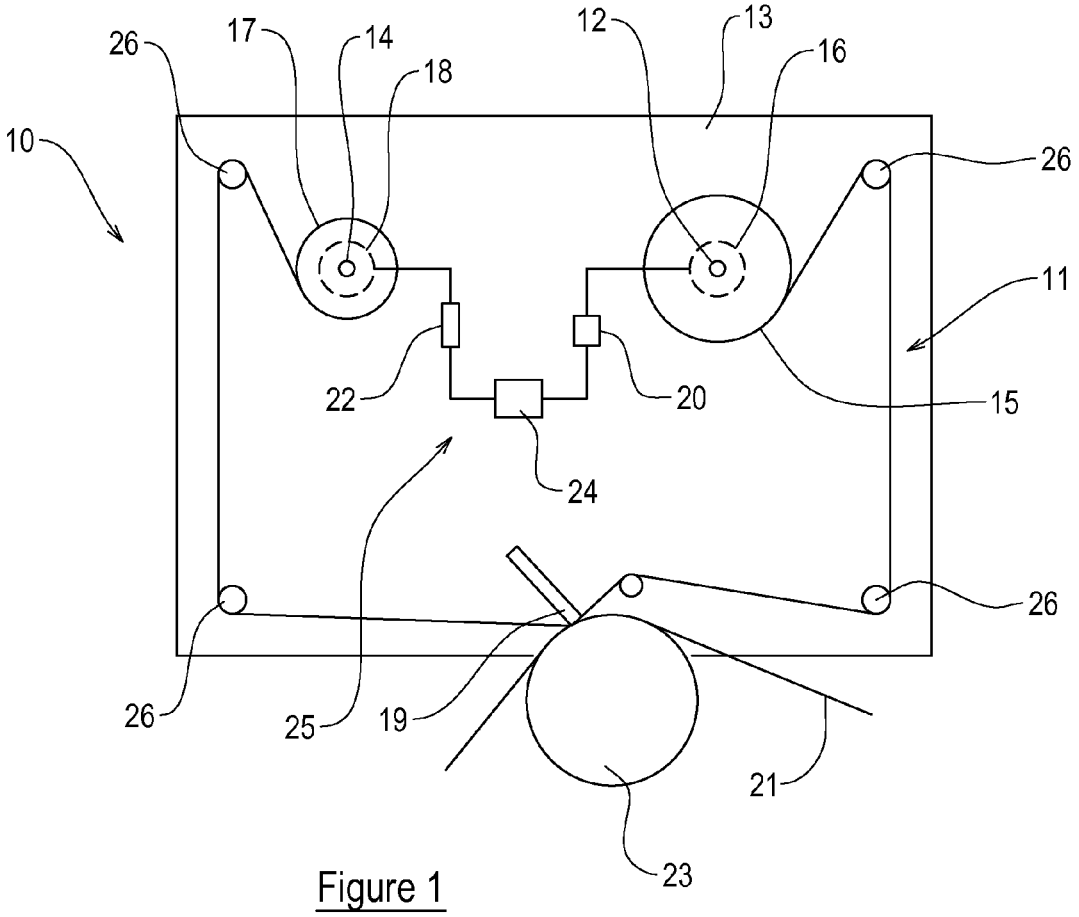
FIG. 1 is an illustrative view of part of a thermal printing apparatus having a motor control system including a pair of brushless DC motors.
Figure 2:
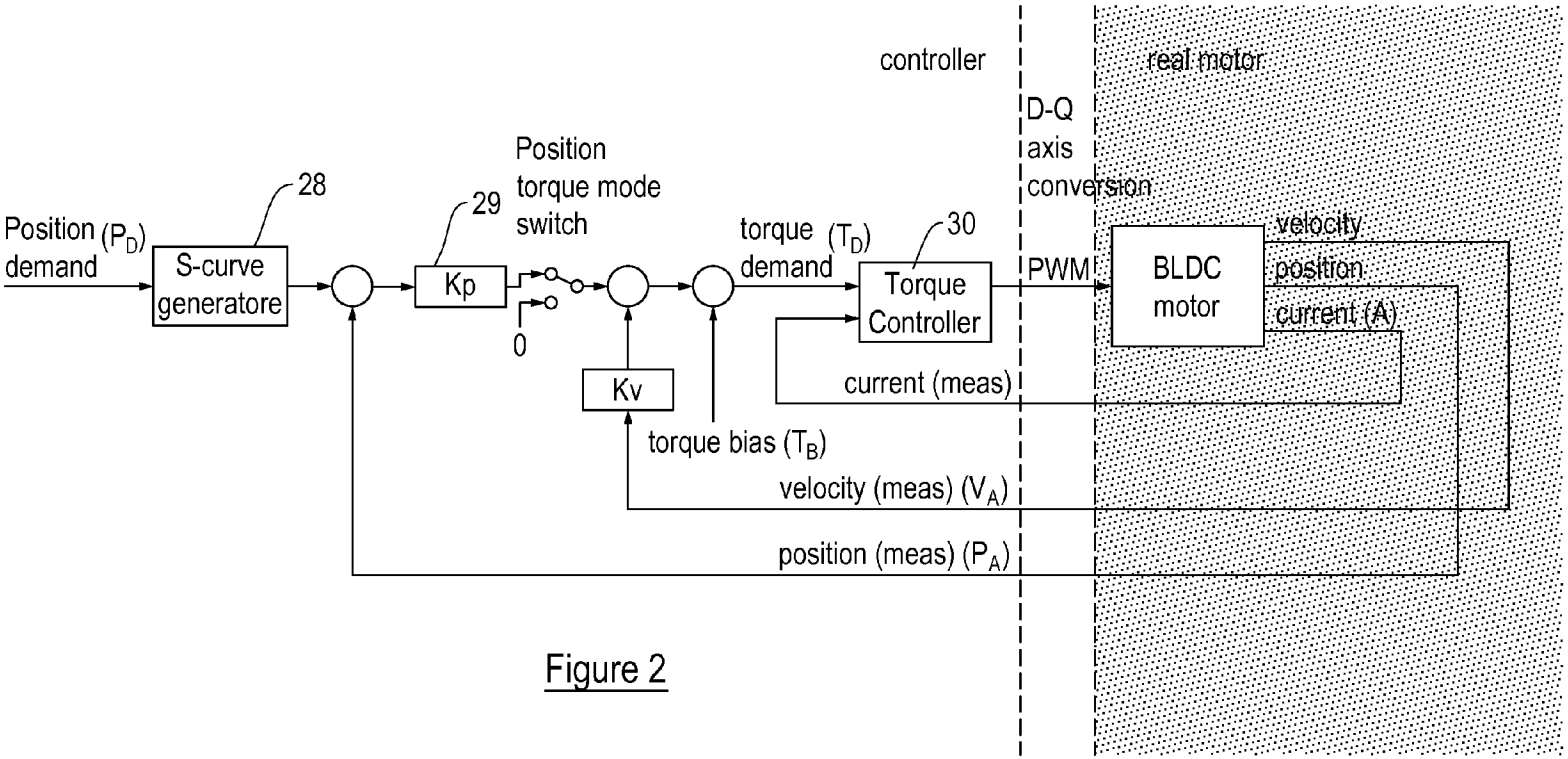
FIG. 2 is an illustrative view of a feedback circuit of the motor control system.

Referring to FIG. 1, there is shown a part of a first embodiment of a printing apparatus 10. The printing apparatus 10 includes a tape drive shown generally at 11. The printing apparatus includes a housing 13, in or on which is mounted a first spool support 12 and a second spool support 14, which form part of the tape drive 11. A spool of tape 15, 17, for example inked printer ribbon, is mountable on each of the supports 12, 14. The spool supports 12, 14 are spaced laterally from one another. The printing apparatus 10 also includes a printhead 19 for transferring ink from the tape to a substrate 21 which is entrained around a roller 23. Depending upon the configuration of the printer, the substrate 21 may be positioned on a platen adjacent the printhead 19.

Each of the spool supports 12, 14 is independently drivable by a respective motor 16, 18. In the first embodiment of the invention, each of the motors 16, 18 is a brushless DC motor. Each of the spool supports 12, 14 is rotatable clockwise and anti-clockwise by means of its respective motor 16, 18. Each motor 16, 18 is electrically connected to a controller 24 via a sensor 20, 22. This sensor is typically a rotary encoder although it will be appreciated that other technologies are perfectly acceptable. The controller 24 is operable to control the mode of operation of each of the motors 16, 18 and the amount of drive provided by each of the motors 16, 18. Each sensor 20, 22 enables the controller 24 to determine the angular position and rotational speed of a rotor of the respective motor 16, 18. Information relating to the current drawn by each motor 16, 18 is provided to the controller 24. The motors 16, 18, the sensors 20, 22 and the controller 24 all form part of a motor control system 25.

The controller 24 receives inputs relating to a demanded position of each motor 16, 18 to advance the tape to a required position, the actual position of the motor 16, 18, the measured velocity of each motor 16, 18, the current drawn by the motor 16, 18, and a torque bias $T_B$ required by the motor at a given point in time.

The purpose of the torque bias will be explained in more detail below. The position of the controller 24 relative to the remainder of the printing apparatus 10 is irrelevant for the purposes of the present invention.

In use, a supply spool 17, upon which unused tape is wound, is mounted on the spool support 14, and a take up spool 15, upon which used tape is wound, is mounted on the spool support 12. The tape generally advances in a tape path between the supply spool 17 towards the take up spool 15. The tape is guided in the tape path between the spools 15, 17 adjacent the printhead 19 by guide members 26.

The tape drive 11 requires calibration before printing operations can commence. Such calibration is generally required when the printing apparatus 10 is switched on, and when the spools of tape 15, 17 are replaced. The calibration process includes determining an initial estimate of the diameters of each of the spools of tape 15, 17 mounted on the spool supports 12, 14. An example of a suitable method of obtaining such an estimate is described in detail in the applicant's patent GB2310405, also published as U.S. Pat. No. 5,921,689.

As tape passes from one spool to the other, for example from the supply spool 17 to the take up spool 15, it passes over a roller of known diameter. The roller is preferably one of the guide members 26. Tape is drawn from the supply spool 17, with the motor 16 which drives the take-up spool support 12 operating in position control mode. The motor 18 which drives the supply spool support 14 operates in torque control mode to deliver a predetermined torque.

Following the calibration process, the motor control system 25 maintains and updates values for the diameters of the spools 15, 17 by monitoring the amount of tape transferred from the supply spool to the take-up spool. The controller 25 takes into account the thickness of the tape to compute an expected change in the diameters of the spools 15, 17 as the tape moves from the supply spool to the take-up spool. This is known as dead-reckoning. This technique relies on the tension in the tape being kept within an acceptable tolerance during printing operations and advancement of the tape between the spools 15, 17.

When the tape is at rest, the motor control system 25 controls the desired tape tension by operating one motor, for example the supply spool motor 18, in a first control mode, in which position is a dominant control parameter. This first control mode will be referred to herein as "position control mode". The other motor, for example the take up spool motor 16, is operated in a second control mode, in which the dominant control parameter is torque. The second control mode will be referred to herein as "torque control mode".

One motor 18 ensures that the absolute position of the tape relative to the printhead is accurately controlled, whilst the motor in torque control mode 16 sets the tension in the tape at a desired predetermined value.

A demanded position $P_D$ of the motor 18 is received by an S-curve generator 28, an output of which is used, along with an actual position $P_A$ of the motor 18 in an algorithm, preferably a PID algorithm, applied by an electronic filter 29 to determine the change in position required to be carried out by the motor 18. An actual velocity $V_A$ of the motor is input to a second electronic filter 31, which performs an algorithm, again preferably a PID algorithm, and an output of the second electronic filter 31 is used in conjunction with an output of the first electronic filter 29, relating to the change in position of the motor 18, to determine a demanded torque $T_D$ to be provided by the motor 18. A demanded torque $T_D$ and the amount of current A drawn by the motor 18 are fed back to a torque controller 30 to provide a control output to the motor 18. Although the algorithms implemented by the filters 29, 31 are described as being PID algorithms, it will be appreciated that any Linear Time Invariant filter function may be used.

The motor 16 being operated in torque control mode does not use inputs relating to demanded position $P_D$ or actual position $P_A$ of the motor 16. The inputs relating to actual velocity $V_A$ may also be disregarded. The torque controller 30 receives a torque demand $T_D$ based only on the torque bias $T_B$, and optionally upon the actual velocity $V_A$ of the motor 16. The current A of the motor 16 may also be fed back to the torque controller 30 to generate a control output for the motor 16. The intention of the torque bias $T_B$ is to apply a torque offset to the motor 18, which is in position control mode, to completely counteract the constant torque provided by the other motor 16, which is in torque control mode. This then means that the motor 18 in position control mode is only required to produce an instantaneous torque which will hold that motor 18 in position and does not need to compensate for the torque applied by the other motor 16. So if, for example, the motor 16 in torque control mode is applying 3N to the ribbon, the motor 18 in position control mode will have a torque bias applied to generate the equivalent of 3N to balance the tension in the tape.

When the tape is required to be advanced between the spools 15, 17, the controller 25 causes both of the motors 16, 18 to operate in position control mode. The transition of the motor 16 which was previously operated in torque control mode into position control mode is smooth. This transition from torque control mode to position control mode is carried out by gradually reducing the torque bias $T_B$ to a nominal value, which may be zero.

During tape advance, the two motors 16, 18 advance the tape accurately along the tape path past the printhead 19, using the values of the diameters of the spools 15, 17 and a co-ordinated moving target position. The co-ordinated moving target position is arrived at by the control system 25 determining the desired position of the tape at a point in time, and the controller 24 controls the motors 16, 18 to achieve this desired position of the tape.

During tape advance, it is desirable for the amount of tape fed into the tape path from the supply spool 17 to be equal to the amount of tape taken up by the take up spool 15, in order to maintain the tape tension substantially constant. However, this is difficult to achieve in known tape drives because disturbances of the tape which occur during printing operations, and the fact that the spools 15, 17 are not perfectly cylindrical mean that the control of the motors 16, 18 is based upon inaccurate estimates, and thus the tension is unlikely to be kept as near to constant as desired. In the present invention, the smooth transition of the take up motor from position control mode to torque control mode prevents the accumulation of such errors increasing long term drift in the ribbon tension.

Once the advancement of the tape has been completed, one of the spool motors 16, 18, for example the take up spool motor 16, smoothly transitions from position control mode to torque control mode, by increasing the torque bias $T_B$ relating to the motor 16, whilst the other spool motor, for example the supply spool motor 18, remains in position control mode. Gradually increasing the torque bias $T_B$ from zero during deceleration of the tape causes a smooth transition of the motor from position control mode to torque control mode, before the inputs relating to position $P_A$, $P_D$ are disregarded. The other motor, in this case the supply spool motor 18, remains in position control mode, however the value of torque bias $T_B$ applied to this motor may be adjusted, so as to compensate for the increase in torque which is likely to be caused as a result of switching the take up spool motor 16 into torque control mode. In practice, it may be possible to retain a constant torque bias $T_B$ irrespective of whether the motors 16, 18 are stationary or in motion, however, the desired torque bias $T_B$ will be such that it causes the tension in the tape to remain within the acceptable tolerance, by the two motors 16, 18 applying approximately equal and opposite forces on the tape.

The motor control system 25 is capable of testing the accuracy of its control of the advancement of the tape in two ways.

The first method of testing is to determine the ratio of the torques applied to the two motors 16, 18 when the tape drive 11 is stationary. In such a situation, one motor 16, 18 is stationary, whilst the other motor 16, 18 supplies a torque so as to maintain its position, and to maintain the tension in the tape. The ratio of the torques should be the same as the ratio of the diameters of the spools 15, 17 at that time.

The second method of testing is carried out as the tape drive 11 is completing a movement of the tape. As the take up spool motor 16 transitions from position control mode to torque control mode, the controller 24 monitors the angular position change of take up spool motor 16 between its expected target position and its rest position at the correct ribbon tension, using the sensor 20. The angular position change that occurs together with the spool diameter gives a measure of the disturbances and errors in the position control of the motor 16.

The operation of the control system 25 is iterative, in that it takes into account the results of the testing method(s) carried out over a number of tape advancements (printing cycles) to correct the estimate of the diameters of the spools 15, 17 for future printing cycles.

The method of operation of the tape drive 11 described above retains the supply spool motor 18 in position control, as the supply spool 17 is more likely to be cylindrical than the take up spool, the tape on the supply spool 17 not having been unwound, and ink removed from it before being rewound on a different spool. Therefore this mode of operation is more likely to provide accurate positioning of the tape adjacent the printhead 19. However, it will be appreciated that either spool motor 16, 18 could be switched to torque control mode during tape advance.

When power is removed from the motors 16, 18, the control system 25 manages the tension of the tape in the tape path. If the tape is in tension when power is removed from the motors 16, 18, one or both of the spools 15, 17 will be accelerated by the force exerted by the tension in the tape. Even when the tape is no longer in tension, the or each spool 15, 17 which has been accelerated will continue to rotate owing to the momentum of the spool(s) 15, 17, and tape may spill from the printing apparatus 10. Of course, this is undesirable, and unacceptable. To overcome this problem, the control system 25 operates at least one of the motors 16, 18, so as to enable a controlled release of tension from the tape, before power is removed from the motors 16, 18. Alternatively, a mechanical device may be used to inhibit or prevent the acceleration of the spools 15, 17 upon removal of power from the motors 16, 18.

During use of the tape drive 11, energy is wasted in maintaining tension in the tape when the tape drive 11 is idle, i.e. whilst the tape is stationary. It is possible to utilise the control provided by having a separate motor 16, 18, to control each spool 15, 17, to reduce the tension in the tape between periods of activity and thus reduce the power applied to the motors 16, 18. Reducing the power applied to the motors 16, 18 reduces the energy applied to and used by the tape drive 11 as a whole.

A period of activity may be defined as a tape movement corresponding to a single printing operation or a series of movements corresponding to a number of successive printing operations. For the purpose of this invention, a period of inactivity is a period during which the tape drive is operational, but the tape remains (is held) stationary.

As described above, both motors 16, 18, are DC motors, and each motor 16, 18 has an associated incremental encoder 20, 22 monitoring rotation of the respective motor 16, 18.

During a period of activity, i.e. when tape is moved, both motors 16, 18 are operated in position control mode. During a period of inactivity, i.e. whilst the spools 15, 17 and the tape are at rest, the motor control system 25 controls the desired tension in the tape typically by operating one of the motors 16, 18, for example the take up spool motor 16, in torque control mode, whilst the other motor, in this example the supply spool motor 18, remains in position control mode, maintaining a static position of the tape. The torque demanded from the motor 16 sets the tension in the tape.

In known systems, the tension in the tape is maintained substantially constant at all times, during tape movement and at rest. Hereinafter, the tape tension required during tape movement will be referred to as "operational tension". A typical value for the operational tension is approximately 3N. In the present invention, following a period of activity, once the tape has been brought to rest and once the take up spool motor 16 has transitioned into torque control mode, the controller 24 initiates a tension reduction phase, during which the torque provided by the motor 16 is gradually reduced, such that the tension in the tape is reduced to a "resting tension", which is less than the operational tension. In the present example, the resting tension is approximately 1N. The resting tension lies within the acceptable tolerance, which enables the printing apparatus 10 to operate accurately and effectively. For example, it does not adversely affect processes such as dead reckoning.

The reduction in tension occurs after the system has come to complete rest. Once the motors 16, 18 have stopped moving, the tape typically vibrates for a short period. The time taken for the tape to settle, and hence the duration of this period of vibration is dependent upon the design of the printer and the characteristics of the tape. In the present example, the settling time following a printing operation is approximately 250 ms.

The encoder 20 associated with the take up spool motor 16 is monitored by the controller 24 to record the rotation of the motor 16 during the tension reduction phase. When the next period of activity starts, the controller 24 adds the recorded rotation to the motion demanded from the motor 16 which was in torque control mode while the tape was at rest, so that the tape tension is smoothly restored to the operational tension during the acceleration of the tape.

In the present example, the motor which operates in torque control mode whilst the tape is at rest has been described as the take up spool motor 16. In this case, the motor 16 is effectively operated in a reverse direction to reduce the tension in the tape, and the rotational movement performed to reduce the tension will be added to the motion in the forward direction as tape activity resumes, so as to counteract the movement in the reverse direction, and to restore the tension in the tape as the tape accelerates.

In alternative embodiments, the motor which operates in torque mode may be the supply spool motor 18, and the tension in the tape will be reduced by the motor 18 rotating in a direction which corresponds with forward movement of the tape along the tape path, during the tension reduction phase. When a period of activity begins, the recorded rotation of the motor 18 during the tension reduction phase will be removed from the forward movement of the motor to restore the desired operational tension.

The sequence of periods of activity and periods of inactivity may be predetermined for a particular print run, or may be controlled 'on the fly' in response to signals received by the controller 24, for example a signal indicating a change in printing conditions. It is not essential for the tension in the tape to be reduced during every period of inactivity. It will be understood that there may be periods of inactivity during which it is not desired or it is impractical to initiate the power saving mode. For example, some periods of inactivity may not be long enough to allow for the tension to be sufficiently reduced to save energy.

The periods of inactivity during which the tension in the tape, and hence power consumption, are reduced, may be predetermined as part of the planned print run. The power saving mode may be initiated during selected periods of inactivity only. Alternatively or additionally, it is possible to set criteria for determining whether the power saving mode should be initiated for a particular period of inactivity. If one or more of the criteria are met, then power saving mode may be initiated. For example, if a period of inactivity exceeds a predetermined duration, the power saving mode may be initiated, and a tension reduction phase may be initiated by the controller 24.

Preferably, the power saving mode is initiated during periods of inactivity which are typically in the order of a few seconds, and more preferably in excess of the settling time of the tape following a printing operation cycle.

The fact that the controller 24 records data from the encoder 20, 22 associated with the motor 16, 18 which is operated to reduce the tension, during each tension reduction phase, means that even if a tension reduction phase is not completed before a period of activity begins, and the tension has not been reduced to the resting tension, the movement which has been completed is simply counteracted during the next period of activity.

Whilst the energy saving method has been described in conjunction with the method of operating a tape drive as described above, it would be possible to perform such a method in a tape drive including two DC motors which operate in a "standard" configuration, i.e. without transitioning between a position control mode and a torque control mode.

Figure 3:
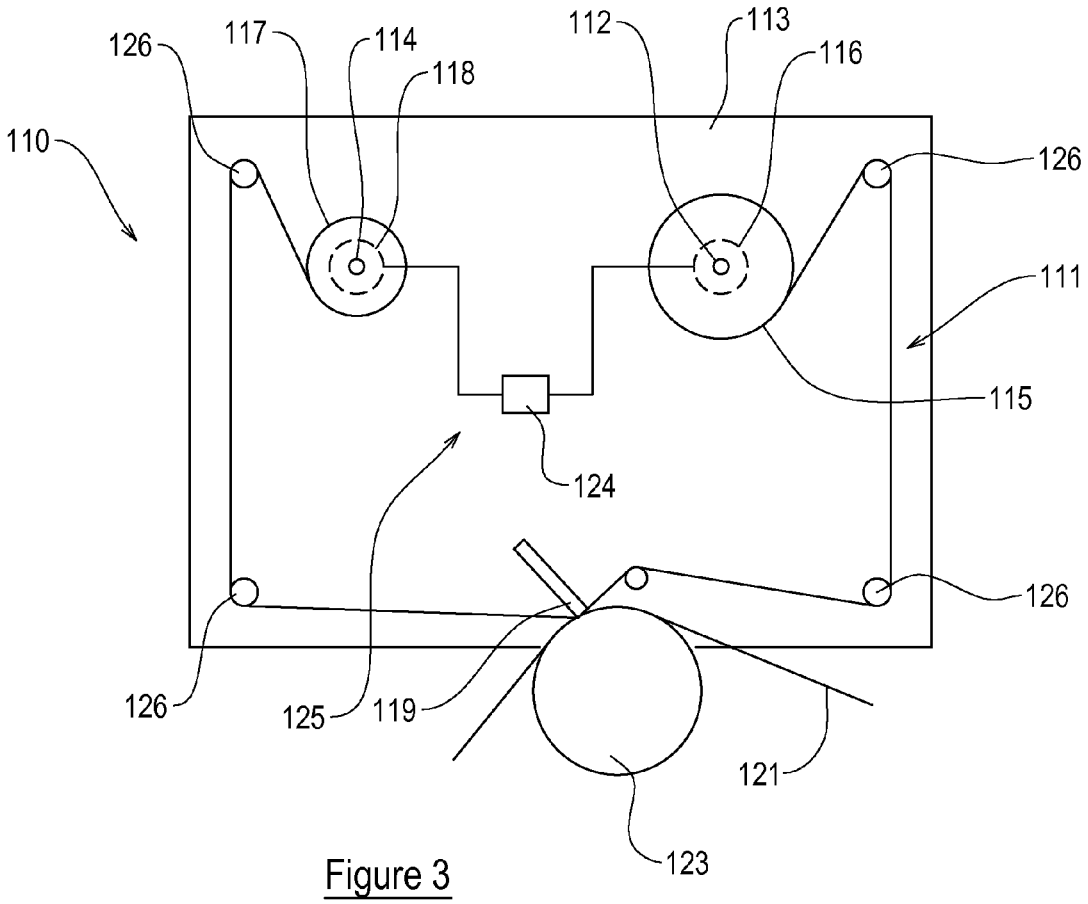
FIG. 3 is an illustrative view of a thermal printing apparatus having a motor control system including a pair of stepper motors.

A second embodiment of a part of a printing apparatus 110 including a tape drive 111 is shown in FIG. 3. The majority of the parts of the second tape drive 111 are similar to those of the first tape drive 11, and thus the same reference numerals have been used, prefixed by a '1'.

The tape drive 111 includes a pair of stepper motors 116, 118, instead of brushless DC motors, and each motor 116, 118 does not have a respective sensor, to provide information about the position of the motor 116, 118, since this information is inherent in the case of a stepper motor. However, the tape drive 111 includes a sensor 132, which determines the tension in the tape. In the example shown, the tension sensor 132 includes a moveable roller which replaces one of the guide rollers 126. The moveable roller presses against a load cell, which is used to determine the tension in the tape.

The tape drive 111 is calibrated in a similar fashion to the tape drive 11, in that the diameters of the spools are determined during a calibration step, and during operation, dead reckoning is relied upon to provide information relating to the instantaneous diameters of the spools 115, 117, in order to maintain the tension in the tape within the acceptable tolerance. The operation of the tape drive 111 is generally in accordance with known methods, inasmuch as the controller 124 controls the movement of each motor 116, 118 to unwind tape from the supply spool 117 and to wind tape on to the take up spool 115. The ability to position the tape accurately adjacent the printhead 119 in order to carry out printing operations relies upon a desired position of each motor 116, 118 being communicated to the respective motor 116, 118 by the controller 124, and each motor 116, 118 turning through the appropriate number of steps to carry out the movement. This is the case for movements which occur during both printing operations and non-printing operations, for example when the tape is moved in a reverse direction, in order to avoid wasting tape.

The control of the motors 116, 118 is such that the amount of tape being fed into the tape path from the supply spool 117 and the amount of tape wound on to the take up spool 115 is approximately equal for every movement. The tension in the tape must remain within an acceptable tolerance in order for the movement and positioning of the tape to remain accurate.

The tape drive 111 is also operable in a power saving mode, but the implementation of the power saving mode for the second embodiment is different than for the first embodiment, owing to the difference in operation of the tape drives 11 and 111.

Following a period of activity of the tape drive 111, during which the tape is moved and maintained at the higher, operational tension of approximately 3N, the tape drive begins a period of inactivity and the controller 124 initiates the power saving mode. The take up spool motor 16 is rotated in single steps (or microsteps) to reduce the tension in the tape to the resting tension, which is approximately 1N. The tension in the tape is sensed by the tension sensor 132, which provides signals indicative of tension to the controller 124, which, in turn, controls the motors 16, 18, to achieve the desired resting tension. Monitoring and generally maintaining the tension in a tape at a desired level in a tape drive such as tape drive 111 is known in the art.

The number of steps taken by the motor 16 during the tension reduction phase is recorded by the controller 124. When the next period of activity starts, the number of steps recorded by the controller 124 is added to the motion demanded of the take up spool motor 16 by the controller 124 such that the tape tension is smoothly increased from the resting tension to the operating tension during the acceleration of the tape up to its operational speed.

Although this example has been described with the take up spool motor 116 being operated to reduce the tension in the tape whilst the tape drive 111 is operated in energy saving mode, the supply spool motor 118 may alternatively be operated to reduce the tension. It is also possible for both motors 116, 118 to be operated by the controller 124 to reduce the tension in the tape to the resting tension. With the spools 115, 117 wound in the senses shown in FIG. 3, the motors 116, 118 would move in opposite directions in order to reduce the tension in the tape.

As with the first embodiment, the tension in the tape is always retained within an acceptable tolerance, so as to enable accuracy in tape movement to be maintained, for example still to enable methods such as dead reckoning to be performed. The lower resting tension shall be sufficient to maintain the tape's position in the tape drive 11 (measured perpendicular to the direction of tape travel relative to the printhead 19). Thus, print quality and performance are not jeorpardised by the energy saving method.

In both embodiments, the rotational movement required to be performed by the motor 16, 18, 116, 118 to reduce the tape tension to the resting tension is a function of the length of the tape path between the spools 15, 17, 115, 117 and the elastic properties of the tape.

Whilst the invention has been described in relation to thermal printing apparatus, it will be appreciated that the motor control system may be utilised in relation to other devices or apparatus.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of operating a tape drive which includes a pair of tape spool supports, upon one of which a supply spool is mountable and upon a second one of which a take up spool is mountable, each tape spool support being driveable by a respective motor to transfer tape between the spools, the tape drive further including a controller to control each of the motors, wherein the method includes selecting one or more periods of inactivity of the tape drive for a particular print run, and reducing tension in tape extending between the two spools during the one or more periods of inactivity of the tape drive when the tape is substantially stationary, and wherein the one or more periods of inactivity are selected before the particular print run begins.

2. A method according to claim 1 wherein the reduction in tension during the one or more periods of inactivity reduces the amount of electrical energy required to operate the tape drive.

3. A method according to claim 1 wherein the or each period of inactivity meets a predetermined criterion.

4. A method according to claim 3 wherein the or each period of inactivity exceeds a predetermined duration.

5. A method according to claim 1 wherein the tension is reduced from an operating tension of approximately 3N.

6. A method according to claim 1 wherein the tension is reduced to a rest tension of approximately 1N.

7. A method according to claim 1 wherein an amount of torque provided by at least one of the motors is reduced.

8. A method according to claim 1 wherein the controller controls at least one of the motors to rotate its associated spool by an amount required to reduce the tension by a desired amount.

9. A tape drive including a pair of tape spool supports, upon one of which a supply spool is mountable and upon a second one of which a take up spool is mountable, each tape spool support being driveable by a respective motor to transfer tape between the spools, the tape drive further including a controller to control each of the motors, wherein the controller is operable to control at least one of the motors to select one or more periods of inactivity of the tape drive for a particular print run, and reduce the tension in a tape extending between the two spools during the one or more periods of inactivity when the tape is substantially stationary, and wherein the one or more periods of inactivity are selected before the particular print run begins.

10. A tape drive according to claim 9 wherein at least one of the motors for driving the spools is a stepper motor.

11. A tape drive according to claim 10 wherein both of the motors for driving the spools are stepper motors.

12. A tape drive according to claim 11 wherein at least one of the motors for driving the spools is a DC motor.

13. A tape drive according to claim 12 wherein both of the motors for driving the spools are DC motors.

14. A tape drive according to claim 12 wherein the or each DC motor has an associated sensor for determining the angular position and rotational speed of the motor, and wherein the or each motor is operable in a first control mode in which position is a dominant control parameter and in a second control mode in which torque is a dominant control parameter.

15. A printing apparatus including a tape drive according to claim 9 for transferring a tape carrying a marking medium and a printhead for transferring the marking medium to a substrate.

16. A printing apparatus according to claim 15, wherein the printing apparatus is a thermal printing apparatus.

17. A method of operating a tape drive which includes a pair of tape spool supports, upon one of which a supply spool is mountable and upon a second one of which a take up spool is mountable, each tape spool support being driveable by a respective motor to transfer tape between the spools, and at least one of the motors including an encoder, the tape drive further including a controller to control each of the motors, wherein the method includes:

when the tape drive begins a period of inactivity and the tape is substantially stationary, reducing tension in the tape using the controller, measuring a value corresponding to rotation of the at least one of the motors during tension reduction using the encoder, and storing the value measured by the encoder using the controller; and when a period of activity begins and the tape moves for a printing operation, the controller operates both of the motors using the stored value, and accelerating the motors such that tape tension is restored to operational tension as the tape is accelerated for a printing operation.

18. A method according to claim 17 wherein the reduction in tension during the period of inactivity reduces the amount of electrical energy required to operate the tape drive.

19. A method according to claim 17 wherein the period of inactivity meets a predetermined criterion.

20. A method according to claim 17 wherein an amount of torque provided by the at least one of the motors is reduced.

* * * * *